US006386214B1

(12) United States Patent
Clarke

(10) Patent No.: US 6,386,214 B1
(45) Date of Patent: May 14, 2002

(54) UMBRELLA OPERATING SYSTEM

(76) Inventor: Dougan H. Clarke, 1770 SW. 13th Ave., Miami, FL (US) 33145

( * ) Notice: Subject to any disclaimer, the term of this patent is extended or adjusted under 35 U.S.C. 154(b) by 0 days.

(21) Appl. No.: 09/433,881

(22) Filed: Nov. 4, 1999

(51) Int. Cl.[7] ..... A45B 25/14

(52) U.S. Cl. ..... 135/20.3; 135/16; 135/28; 135/38; 135/32; 135/98; 248/545; 248/533; 248/156

(58) Field of Search ..... 135/98, 15.1, 16, 135/20.3, 27, 28, 31, 32, 38, 39, 118, 43; 248/511, 518, 523, 533, 545, 156

(56) References Cited

U.S. PATENT DOCUMENTS 760,598 A * 5/1904 Wynegar ..... 248/518
1,801,913 A * 4/1931 Frederick ..... 135/20.1
2,745,421 A * 5/1956 Russell ..... 135/38
4,567,907 A * 2/1986 Dubinsky ..... 135/38
4,832,304 A * 5/1989 Morgulis ..... 135/16 X
4,928,718 A * 5/1990 Apple ..... 135/22
4,993,445 A * 2/1991 Dubinsky ..... 135/38
5,020,557 A 6/1991 Apple
5,174,319 A * 12/1992 Chou et al. ..... 135/20.3
5,284,171 A * 2/1994 Liu ..... 135/20.3
5,337,989 A 8/1994 Apple
5,355,903 A * 10/1994 Haddad et al. ..... 135/20.1
5,640,984 A * 6/1997 Dubunsky ..... 135/22 X
5,749,386 A * 5/1998 Samuel, Jr. ..... 135/16
5,836,328 A * 11/1998 Lee ..... 135/25.2
5,871,024 A * 2/1999 Vanderminden, Sr. ..... 135/20.1
6,173,721 B1 * 1/2001 Mery ..... 135/20.3 X

* cited by examiner

*Primary Examiner*—Winnie S. Vip
(74) *Attorney, Agent, or Firm*—Malloy & Malloy, P.A.

(57) ABSTRACT

An umbrella operating system allows for the simple opening, closing and locking of an umbrella while allowing the frame to freely rotate about the pole, wherein the pole is held in a stationary position. The umbrella includes a pair of hub members mounted about a pole member wherein the lower hub member is slidable up and down the pole. A pulley system with locking cam member may be employed to allow the umbrella to safely and easily open to any desired level. A locking stabilizer arm may be used to secure the main hub member in the fully open position and a stabilizer base provides strong support to the pole member to help it withstand severe weather conditions. The umbrella is rotatable about the pole axis regardless of the degree to which it is opened.

12 Claims, 8 Drawing Sheets

UMBRELLA OPERATING SYSTEM

FIELD OF THE INVENTION

This invention relates to umbrellas, and more particularly to an umbrella system having improved stabilization qualities and customization features.

BACKGROUND AND SUMMARY OF THE PRESENT INVENTION

Outdoor umbrellas are employed to shield people from the sun, wind, rain, and other elements of nature. Many umbrellas have been developed to simplify and improve the operational features of the umbrella as well as to add structural stability to the typical umbrella. However, many such prior art umbrellas require the use of a crank to open and close the umbrella or require placing one's hand in a compromising position in order to lock and unlock the umbrella from its open position. Such action is often troublesome and inconvenient, and can result in injury.

By the present invention, there is provided a versatile outdoor umbrella operating system which allows an umbrella to be safely and easily opened to any degree, easily rotated, and securely stabilized. The present invention includes a pair of hub members mounted to an umbrella pole member wherein one hub member is slidable between the top and bottom ends of the pole. The hub members are rotatable about the pole. A pulley system is employed to allow the umbrella to be easily adjusted to any degree of openness and simply locked in place. A stabilizing arm may be employed to bolster support to the umbrella and provide a safer, more effective way to lock and unlock the umbrella in its fully extended position. A base plate member having a flip lid attachment is employed to provide stability at the bottom end of the umbrella as well as to provide a means to keep the umbrella base opening covered when the umbrella is removed.

It is thus one object of the present invention to provide an umbrella assembly capable of being opened to any desired level.

It is another object of the present invention to provide an umbrella assembly capable of being opened to any desired level while being rotatable.

It is a further object of the present invention to provide an umbrella assembly which eliminates the need for a crank lift to open and close the umbrella canopy.

It is yet another object of the present invention to provide an umbrella assembly which eliminates the need for a security pin beneath the lower movable hub member to retain the umbrella in the open position.

It is another object of the present invention to provide an umbrella assembly having a safe and effective base stabilizer.

BRIEF DESCRIPTION OF THE DRAWINGS

FIG. 4-A is a partial front elevational view of the present invention, similar to that shown in FIG. 4, but shown with both a stabilizer arm and pulley means.

DETAILED DESCRIPTION OF THE PREFERRED EMBODIMENTS

Figure 1:
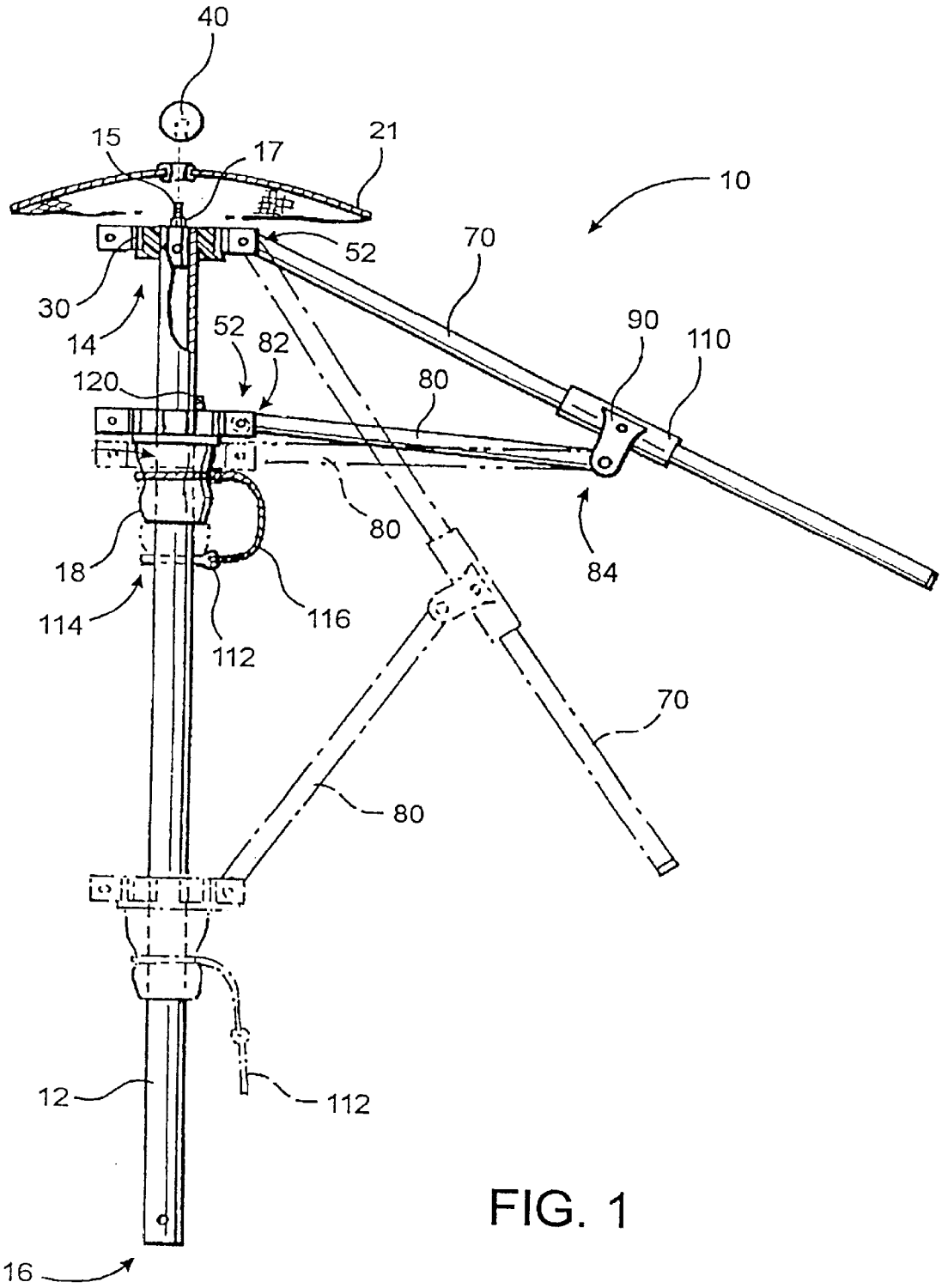
FIG. 1 is a partial exploded front elevational view in partial cross-section of an umbrella frame using a security pin, with the umbrella closed position shown in phantom.

As shown in FIGS. 1 through 9, there is provided an umbrella operating system 10 for use in stabilizing an umbrella and in easily and quickly opening, closing and rotating an umbrella. The umbrella assembly 10 is durable and weather resistant, and includes a longitudinally extending pole member 12 which can be made of wood, aluminum or other material. In one embodiment, the pole member is made of 40 gauge aluminum. The pole member 12 has a top end 14 and a bottom end 16 and the bottom end 16 may be secured to a reinforced concrete base, for example.

Figure 2:
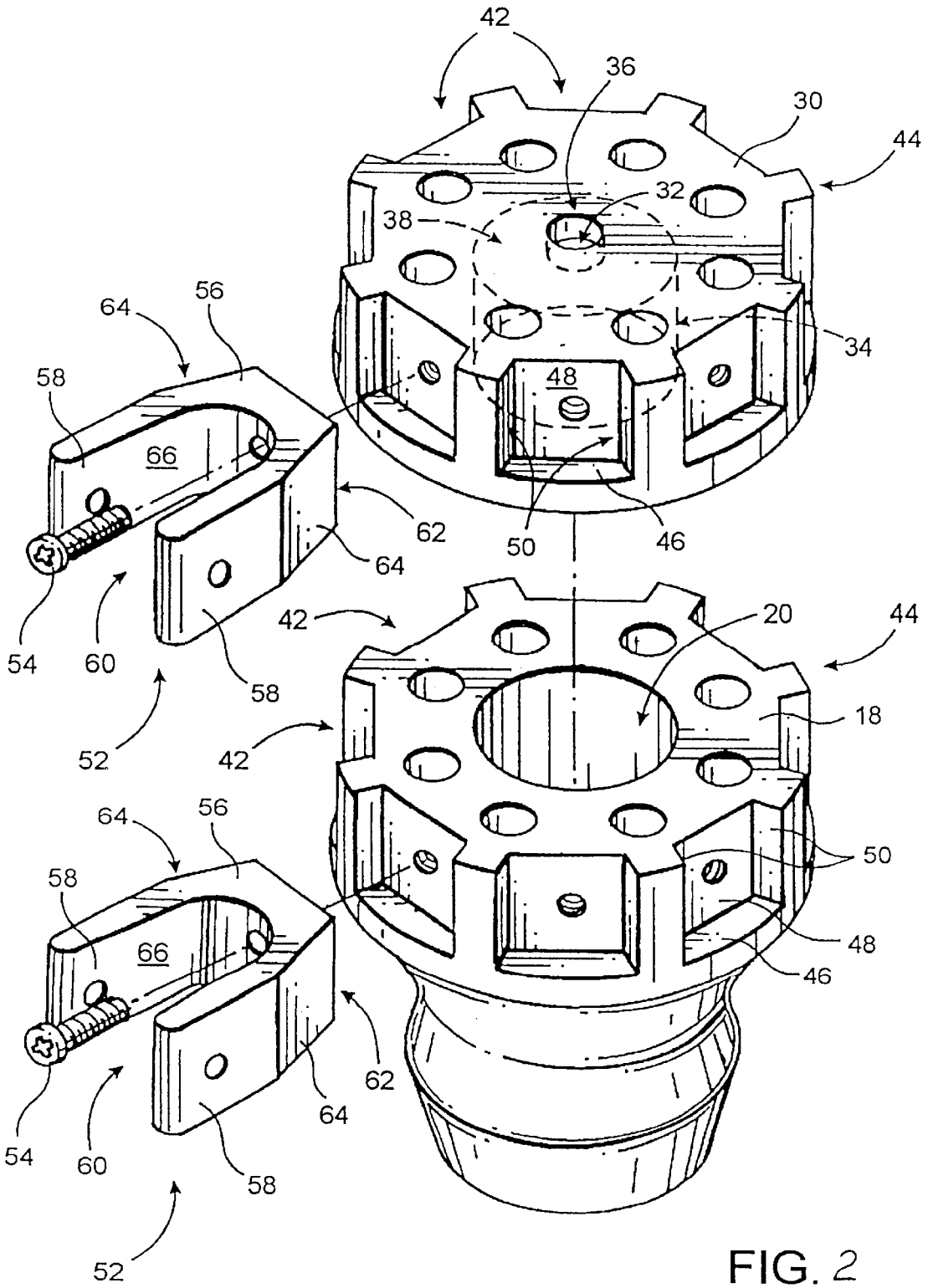
FIG. 2 is an exploded perspective view of one embodiment of the hub members of the present invention, showing the hub connector joints.
Figure 4:
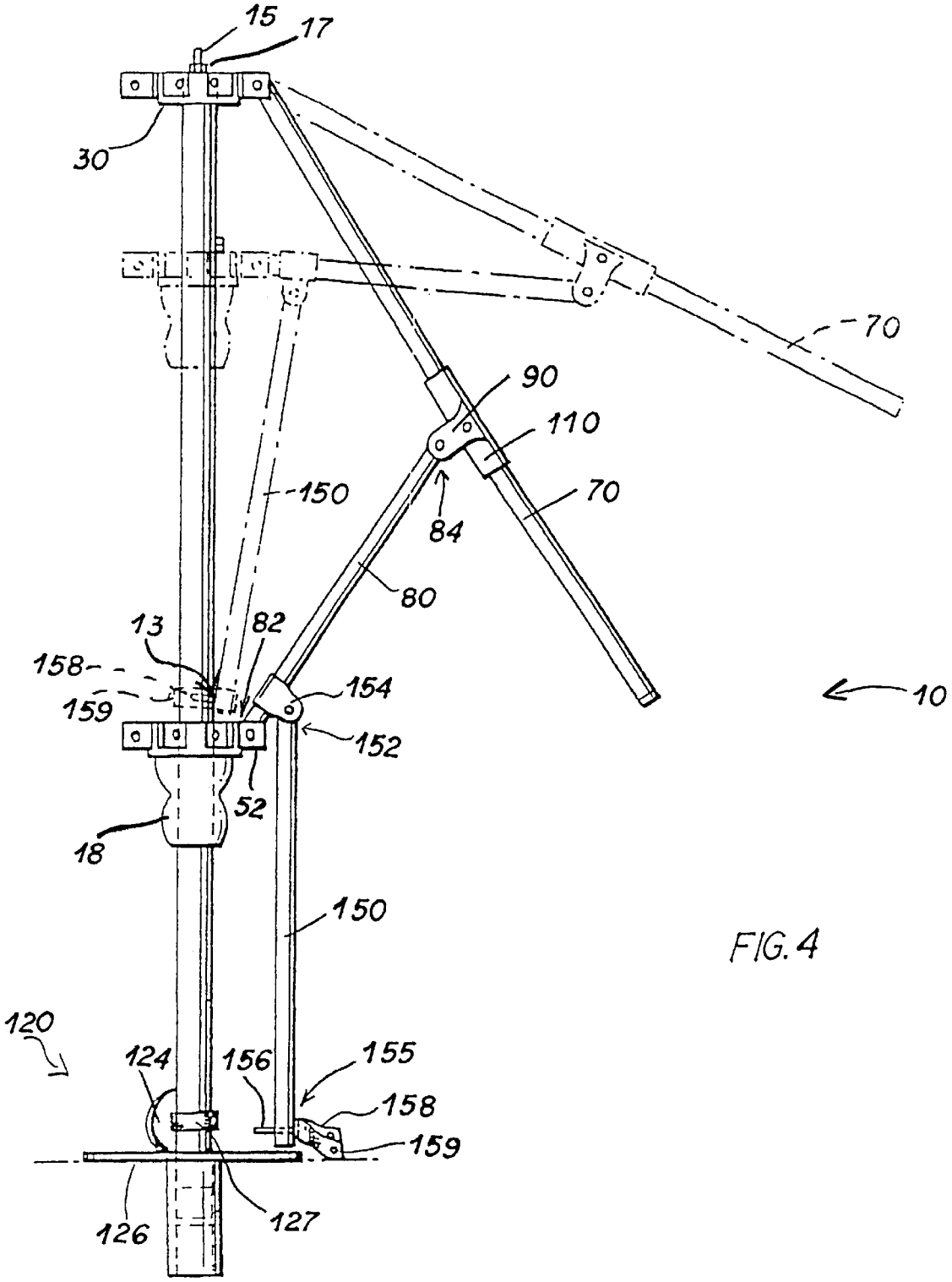
FIG. 4 is a partial front elevational view of one embodiment of the umbrella of the present invention, shown with stabilizer bar and base member and with the open position of the umbrella shown in phantom.
Figure 4A:
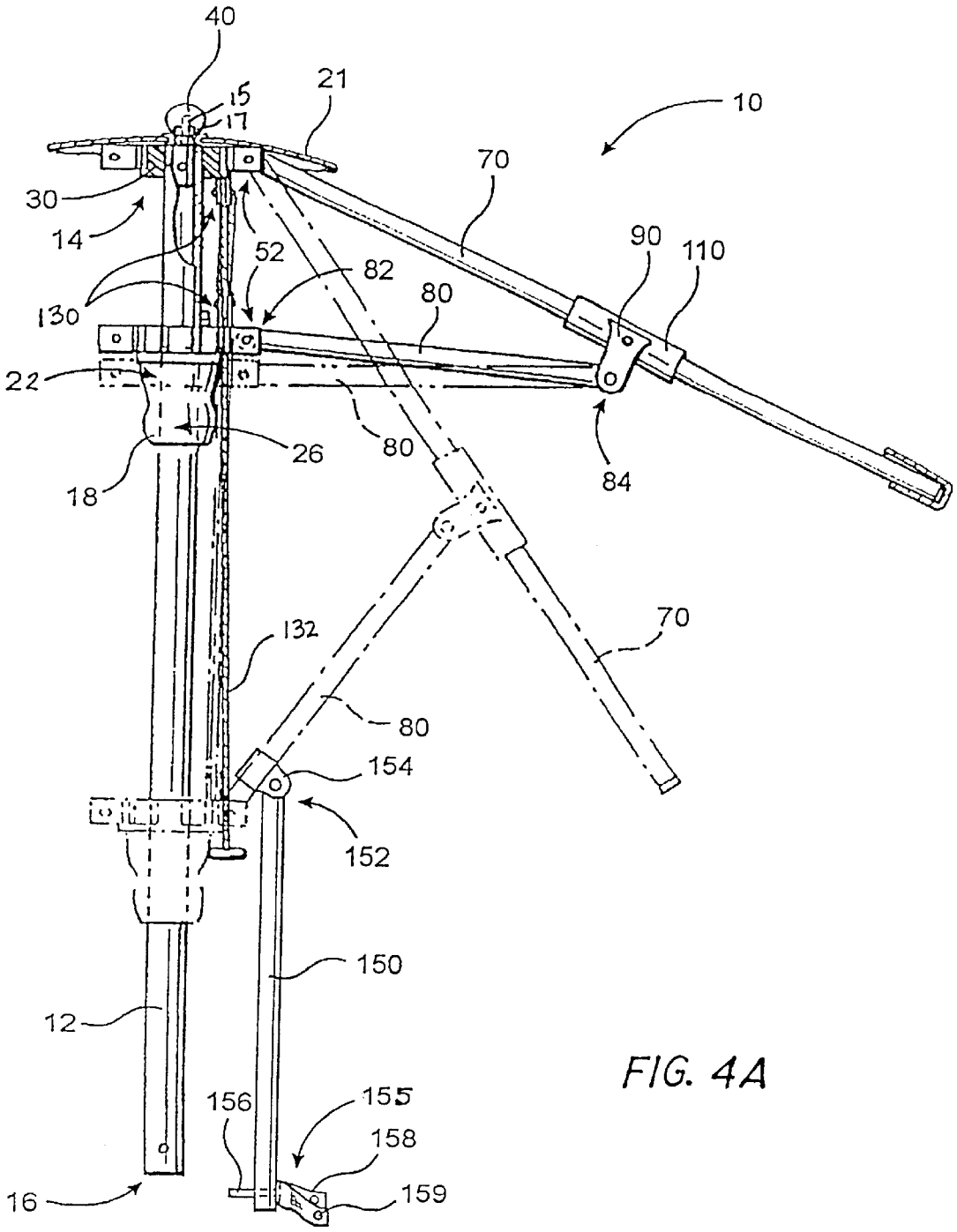

As shown in FIGS. 1, 2 and 4, a main hub member 18 having a central cavity 20 extending axially therethrough is secured about the central pole member and is slidable between the top 14 and bottom 16 ends of the pole member. The main hub member 18 is also capable of rotating about the pole member axis. An upper or secondary hub member 30 is provided near the top end 14 of the pole 12. The secondary hub member 30 is provided with a central cavity 32 extending axially therethrough, wherein the cavity includes a pole receiving portion 34 and a narrower upper portion 36 which extends through an interior wall 38 of the secondary hub member. The interior wall 38 maintains the hub member in position at the top end 14 of the pole 12. The hub members 18, 30 may be made of injection molded thermoplastic, such as DELRIN with TEFLON, for example, so as to resist rust, UV degradation, dry rot, and water damage.

As shown in FIG. 1, a threaded bolt 15 extends from the central pole 12 through the narrow upper portion 36 of the secondary hub member central cavity 32. A nut 17 tightened about the bolt 15 is capable of maintaining the secondary hub member 30 in substantially rigid position about the pole 12. When desired, the nut 17 may be loosened so as to allow the secondary hub member to rotate about the pole axis. A finial or end cap 40 is also secured to the bolt 15 for aesthetic purposes once a canopy 21 has been positioned atop the frame assembly.

As shown in FIG. 2, the main 18 and secondary 30 hub members are further provided with slots 42 formed at intervals about their respective radial edges 44. The slots 42 are three sided and include a base 46, a back wall 48, and a pair of side walls 50. The back wall faces radially outwardly from the hub members 18, 30 and the side walls extend outwardly from the slot back wall 48 at diverging angles. In one embodiment of the invention, the slots are approximately ¼ inch in depth and the slot back wall is approximately ¾ inches in width.

As shown in FIG. 2, hub connector joints 52 are insertable within the hub member slots 42 and may be secured therein by screws 54, for example. The hub connector joints may be made of injection molded thermoplastic or stamped metal, for example. The hub connector joints are provided with a base portion 56 and a pair of substantially parallel side walls 58 which define an interior aperture 60. The hub connector joints also have a back face 62 and a pair of corner walls 64 which extend outwardly from the back face 62 at diverging angles. The back face 62 and corner walls 64 mate respectively with the slot back wall 48 and slot side walls 50. Thus, the angles with which the corner walls 64 and slot side walls 50 diverge from the back face 62 and slot back wall 48, respectively, are substantially identical. In one embodiment of the invention, this angle is approximately 104 degrees. Providing the slots 42 with three walls 62, 64 and a base portion 56 ensures a snug fit of the hub connector joints within the hub member slots and helps prevent the joints 52 from twisting or displacing under stress. Further, the depth and width of the slots allow the hub connector joints to be readily secured and removed from within the slots using a screw 54, as shown in FIG. 2. While a screw member is shown as the means of attachment for the hub connector joints within the hub member slots, other forms of attachment may be employed, such as a machine threaded bolt, fitted notch or other element which allows the hub connector joints to be easily attached and removed. As shown in FIG. 2, the interior surface 66 of the hub connector joints 52 may be rounded and substantially U-shaped so as to provide clearance for rib and strut members, as described hereinafter. In the embodiment of the invention as shown in FIG. 2, the hub members 18, 30 are provided with eight slots 42 so as to accommodate up to eight hub connector joints 52.

Figure 3:
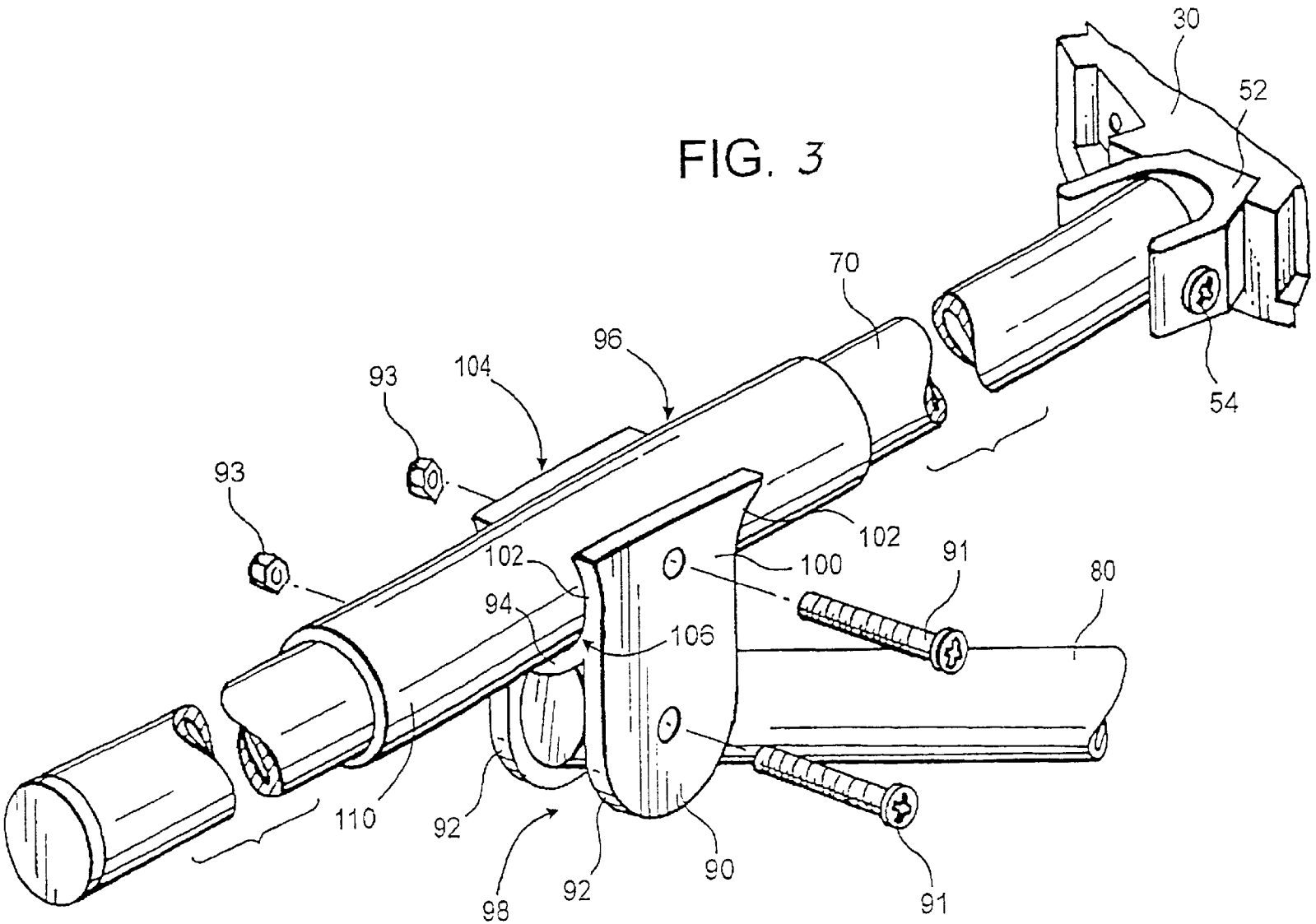
FIG. 3 is an exploded perspective view of the collar member of the present invention.

As shown in FIGS. 1, 3 and 4, rib members 70 are pivotally secured to the hub connector joints 52 of the secondary hub member 30. The rib members 70 form the outer framework of the umbrella frame of the present invention. Strut members 80 are pivotally secured at a first end 82 to the hub connector joints 52 of the main hub member 18 and are pivotally secured at a second end 84 to the rib members 70 at a point near the approximate midpoint of the rib members. The strut members 80 provide support for the rib members when the umbrella frame is in the extended or open position. Pivotal attachment of the rib and strut members to their respective hub connector joints may be exacted using a single screw 54 extending through the hub connector joint and rib or strut member, machine threaded bolt, fitted notch or other like joinery that allows the hub connector joints to be easily replaceable. The rib and strut members may be made of aluminum or wood, for example.

As shown in FIG. 3, the strut members 80 are pivotally secured to the rib members 70 by a collar member 90. The collar member 90 includes a pair of substantially parallel outer walls 92 and a central divider wall 94 which combine to define an upper channel portion 96 and a lower slot portion 98 on opposite sides of the divider wall 94. The upper portion 100 of the collar member outer walls 92 which define the channel portion 96 includes outwardly diverging side edges 102 and a substantially flat top edge 104. The channel portion 96 also has a substantially rounded interior surface 106 adapted for receiving the rib members. As shown in FIG. 3, the channel portion interior surface 106 extends around over one half the circumference of the rib member. As shown in FIG. 3, the rib members 70 may be secured within the collar member channel portion 96 by a screw 91 and nut 93. The substantially flat top edge 104 of the collar member avoids contact with the umbrella canopy which is positioned over the rib members and thereby helps prolong the life of the canopy employed. The strut members 80 are pivotally secured to the slot portion 98 of the collar member 90 by a screw 91 and nut 93, as shown in FIG. 3. Also, as shown in FIG. 3, a substantially cylindrical sleeve member 110 may be employed between the collar member 90 and the rib member 70 to reinforce the support provided by the strut member 80 to the rib member 70. In one embodiment of the invention, the sleeve member 110 is made of aluminum.

Although main hub member 18 is moveably and axially attached to central pole 12 through central cavity 20 and, therefore, free to rotate and slide about it, the main hub member 18 may be secured in position along the pole in several ways. As shown in FIG. 1, a retaining pin 112 is attached to the main hub member 18 and can be placed within a retaining pin slot 114 in the pole 12 in order to maintain the vertical position of the main hub member 18 along the pole. Alternatively, the main hub member may be maintained in position along the pole using a stabilizer arm, as shown in FIG. 4, or the pulley system as shown in FIGS. 6 through 9.

As shown in FIG. 4, the main hub member may be stabilized in position about the pole member using a stabilizer arm 150. The stabilizer arm 150 is pivotally secured at one end 152 to a strut member 80 by a collar member 154 similar to collar member 90. The second end 155 of the stabilizer arm 150 is provided with a securing member 156 for insertion into a stabilizer opening 13 on the pole member. In one embodiment of the invention, securing member 156 is a set screw. The securing member 156 may also be a pinchable clamp member or other component capable of simple insertion and removal from the stabilizer opening. The stabilizer arm second end 155 is also provided with a locking strap member 158 which can be positioned around the pole and locked together such as by using a snap 159 for added support and to ensure that securing member 156 does not unintentionally slip out of position from within the stabilizer opening 13.

Using the stabilizer arm, whether as shown in FIG. 4 or 4-A, the umbrella main hub member 18 can be lifted and lowered without having to use a crank member or a retaining pin member at a location high up on the pole. This facilitates the overall ease of use of the umbrella in quickly opening, securing, and closing the umbrella canopy.

As shown in FIGS. 6 through 9, the main hub member 18 may also be moved up and down the pole member using a pulley system 130. The pulley system allows for an effortless lift of the main hub member and eliminates the need for a crank lift or a security pin beneath the lower movable hub. The pulley system portion of the present invention allows the remote locking of the lower movable hub without impeding the rotation of the entire canopy assembly.

Figure 7:
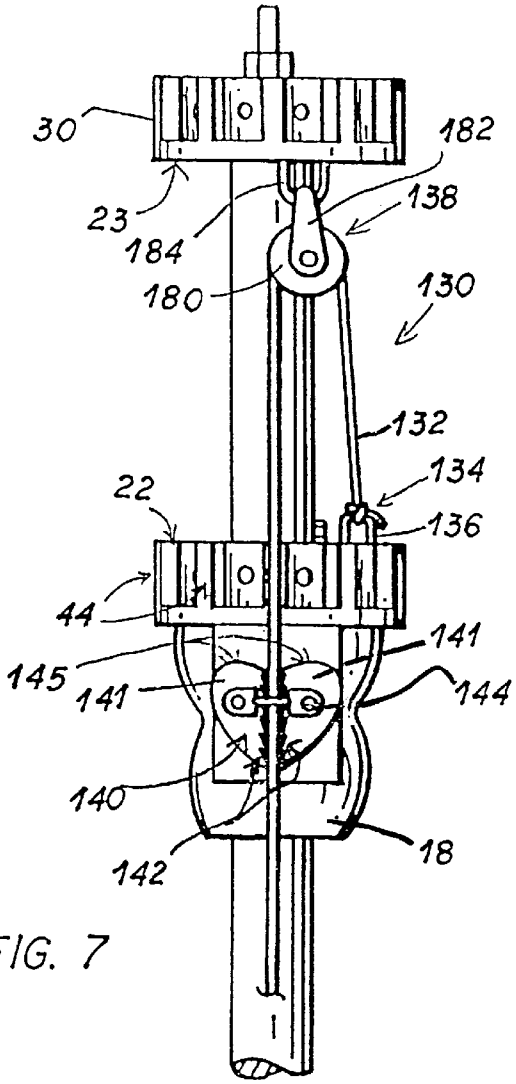
FIG. 7 is a partial front elevational view of one embodiment of the pulley system of the umbrella operating system of the present invention.

In the embodiment of the invention as shown in FIG. 7, the pulley system includes a line member 132 having a first end 134 secured to a bracket member 136 which is secured to the top surface 22 of the main hub member 18. The line member 132 may be a length of rope, for example. In this embodiment, a pulley member 138 is secured to the bottom surface 23 of the secondary hub member and a cam cleat member 140 is secured to the side surface 26 of the main hub member. The pulley member 138 may be a typical pulley having a grooved wheel 180 rotatably mounted to a collar member 182 wherein the collar member is movably secured to a bracket member 184. The pulley securing system of the present invention allows the operator to open the umbrella to any desired level without any additional locks, pins, or levers by simply pulling the line through the automatic locking cam cleat member.

As shown in FIG. 7, the cam cleat member 140 includes a pair of cams 141 each having a toothed side edge 142, and a retaining bracket portion 144. The cams 141 are pivotally mounted to the side edge 26 of the main hub member 18 and the retaining bracket 144 is mounted to the cams 141. In the cam resting position, as shown in FIG. 7, the toothed side edges 142 face one another. In this embodiment, the line member 132 extends from the bracket member 136 through the pulley member 138 and down through the cams 141. A handle is secured to the second end of the line member 132 to promote ease of operation.

Using the pulley system when the umbrella is in its closed position with the main hub member near the pole member bottom end, the user can pull the line member handle whereby the line member will be pulled through the pulley member and the cam cleat teeth 142. This will cause the cams to pivot such that the line will continue to be pulled against the cam smooth outer surfaces 145. This will pull the bracket 136 and main hub member 18 upward so as to open the umbrella. When the user stops pulling the line member, the cams will reverse pivot and the locking teeth will prohibit the movement of the line in either direction. The main hub member will thereby be held in a stable position about the pole member. In this way, the umbrella can be quickly and easily opened to any desired level without the use of a hand crank or a retaining pin placed below the main hub member. When the umbrella is desired to be closed, the line can be pulled outside of the grip of the teeth and released. The retaining bracket 144 maintains the line in alignment with the cam teeth such that the user can easily help the line re-engage the cam member so as to lock the line at the desired level of openness. Only the intentional removal of the line member from the cam teeth with a deliberate sideways and upward movement will allow the umbrella to close. The locking cam cleat thus prevents any unintentional closing of the umbrella from wind gusts or other outside forces.

Figure 6:
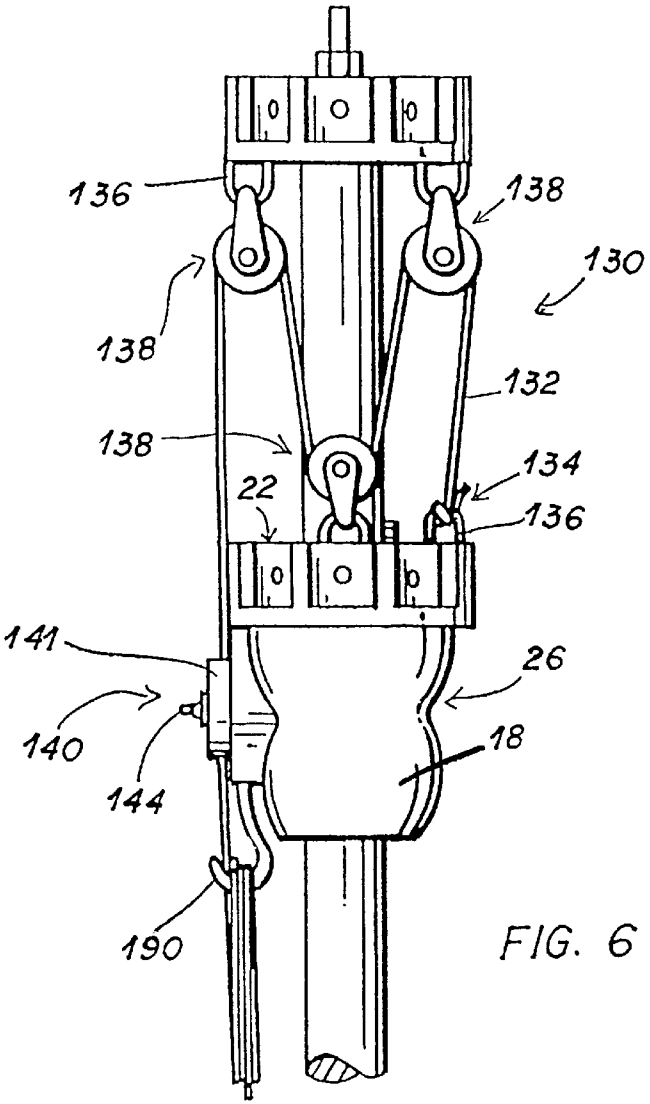
FIG. 6 is a partial side elevational view of one embodiment of the pulley system of the umbrella operating system of the present invention.

As shown in FIG. 7, the pulley system of the present invention may include a single pulley member 138 secured to the lower surface 23 of the secondary hub member 30 and a bracket member 136 secured to the top surface 22 of the main hub member 18. The pulley system of the present invention may also include a pair of pulley members 138 secured to the secondary hub member, as shown in FIG. 6. In this arrangement, the line member 132 extends from the bracket member through a first pulley member 138 on the secondary hub member, through a pulley member on the main hub member, through a second pulley member 138 on the secondary hub member and down through the cam cleat member 140. Such an arrangement provides a mechanical advantage in balance and lifting power to the device. In one embodiment of this arrangement, the secondary hub member pulley members are spaced substantially radially equidistant from the secondary hub member axis. Other variations on the number of pulley members employed on each hub member may be used. Since the hub members 18, 30 are rotatable about the pole axis, providing a pulley system secured to the hub members provides the umbrella of the present invention with the ultimate in versatility, as the umbrella may be opened and rotated to any desired degree completely free of impediments.

As shown in FIG. 7, the line member 132 extends downwardly from the pulley member 138 so as to be substantially coplanar with a main hub member slot wall 44. This keeps the line free from contact with a hub connector joint 52 which could bind and cause unnecessary wear on the line member. Also, as shown in FIG. 6, the line member 132 may be retained on a hook member 190 secured to the main hub member side surface 26.

Figure 9:
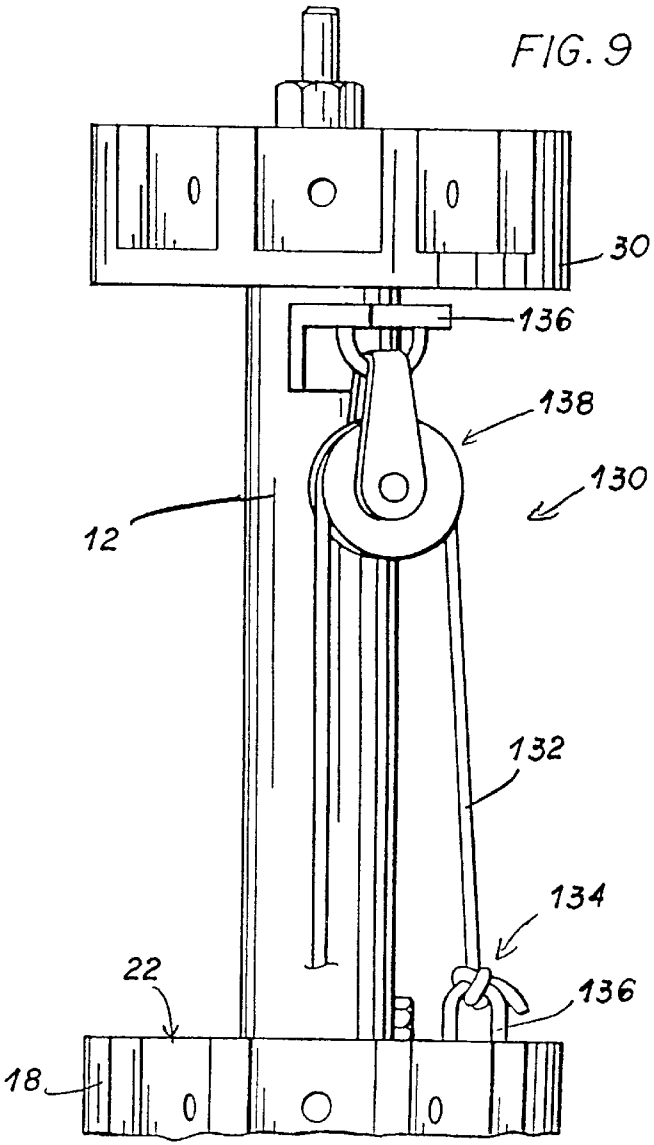
FIG. 9 is a partial perspective view of one embodiment of the pulley system of the umbrella operating system of the present invention.
Figure 8:
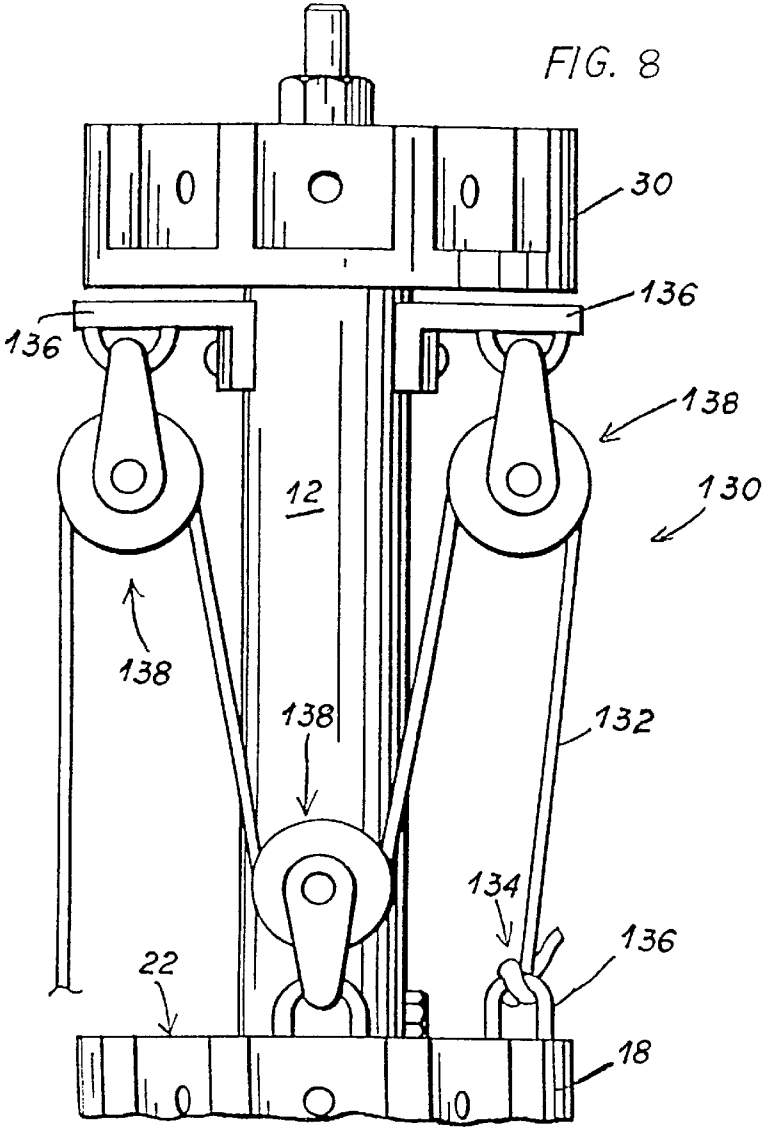
FIG. 8 is a partial side elevational view of one embodiment of the pulley system of the umbrella operating system of the present invention.

As shown in FIGS. 8 and 9, the secondary hub pulley members may optionally be secured directly to the pole member 12 by a bracket member 136 which can extend substantially perpendicularly from the pole member, for example. In this embodiment, the hub members are prohibited from rotating about the pole member.

Figure 5:
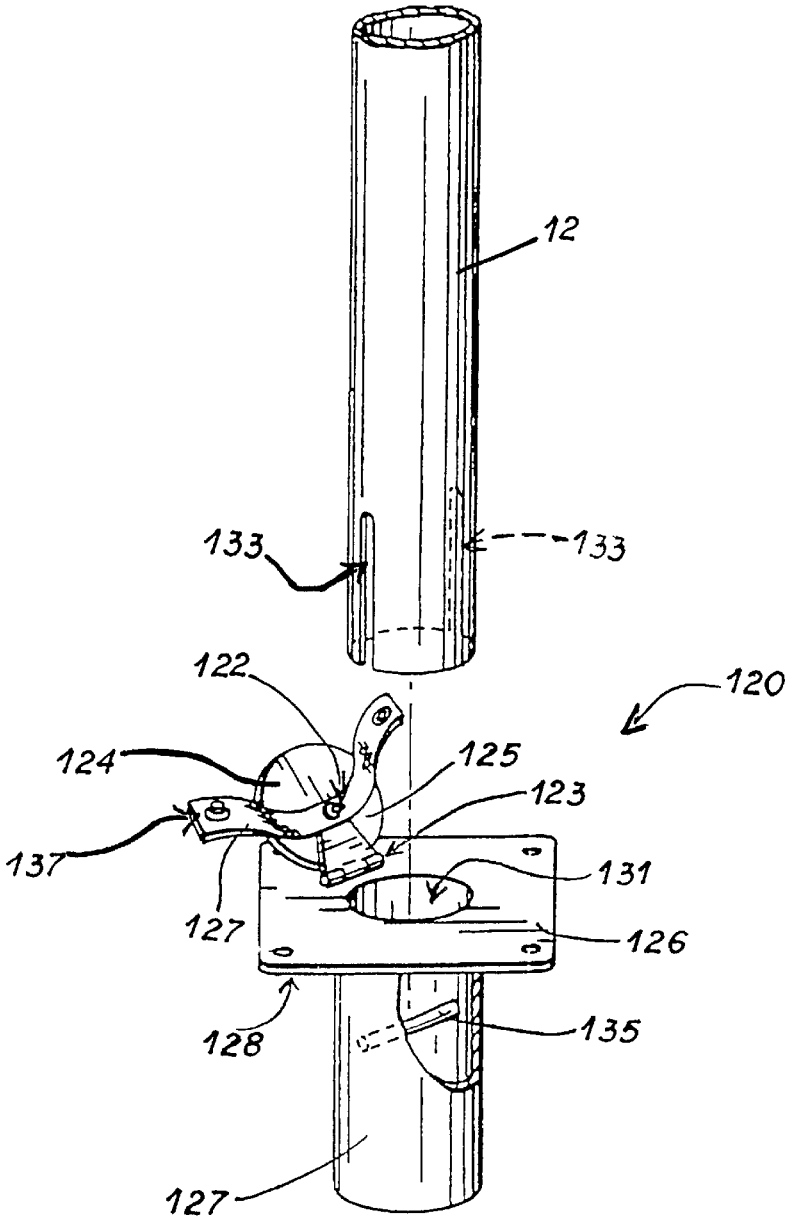
FIG. 5 is an exploded perspective view of the stabilizer base member portion of the umbrella operating system of the present invention.

As shown in FIGS. 4 and 5, the pole member 12 may be stabilized at its bottom end using a support assembly 120. The support assembly 120 includes a base 126 having a plate member 124 secured thereto by a hinge member 123, wherein the plate member 124 has a pin member 122 extending from its inside surface 125. The pin member 122 is receivable by an opening on the pole near the pole bottom end 16. The base 126 includes a substantially cylindrical tube portion 127 extending from its bottom surface 128 and an opening 131 extending through the tube 127 for receiving the pole member 12. In one embodiment of the invention, the pole is provided with a pair of axial slots 133 for mating with a securing rod 135 within the tube 127. The plate member 124 is hingedly secured to the base 126 such that, when the pole member 12 is removed, the plate member 124 can cover the base opening so as to prevent rain, trash, feet and hands, and other like elements from falling into the opening. In one embodiment of the invention, the pin member 122 is a set screw. In a further embodiment of the invention the pin member 122 can be a pinchable clamp member insertable and removable from the pole opening by pinching the sides together. A strap member 127 may also be attached to the plate member 124 and secured about the pole 12 for added support. In one embodiment, as shown in FIG. 5, the strap member includes a snapping lock mechanism 137.

The rigidity and density of all the components described herein can be tempered for a desired flexibility as needed. The pole member may be comprised of metal, wood or fiberglass but not limited to these rigid compositions. The nature of thermoplastic construction with materials like ABS, DELRIN, OLYPROPOLYNE and other ACETALS allow for a degree of flexibility in the hubs, pulley members and cam cleat members of the umbrella frame.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An umbrella, comprising:

a central pole member having a longitudinal axis and top and bottom ends;

a main hub member secured about said central pole member, said main hub member capable of sliding between said bottom and said top ends and including a top surface and a side surface;

a secondary hub member secured to said pole member near said pole top end;

means for supporting a canopy member;

pulley means comprising at least one pulley member secured to said secondary hub member for raising and lowering said main hub member along said pole member;

a bracket member secured to said top surface of said main hub member, and a line member having first and second ends, said first end being secured to said bracket member, said line member cooperatively engaging said pulley member and extending downwardly from said pulley member towards said pole member bottom end;

means for securing said main hub member in a stationary position along said pole member; said securing means comprising a cam member secured to said side surface of said main hub member; and wherein said line member cooperatively engages said cam member as it extends downwardly from said pulley member.

2. The umbrella of claim 1 wherein said cam member has a rested position and includes a pair of cams pivotally secured to said main hub member side surface, said pair of cams each having a toothed inner side edge, said toothed inner side edges facing one another in said rested position of said cam member.

3. The umbrella of claim 2 wherein said cam member further includes a retaining bracket secured to each of said pair of cams.

4. The umbrella of claim 1 wherein said main hub member has a top axial end and wherein said top axial end has a radial edge with a plurality of slots formed at intervals thereabout, said slots being individually separated by a respective slot wall.

5. The umbrella of claim 4 wherein said line member extends downwardly from said pulley member in substantially coplanar relation to a slot wall of said main hub member.

6. The umbrella of claim 1 wherein said secondary hub member includes a bottom surface and wherein said at least one secondary hub pulley member is secured to said secondary hub bottom surface.

7. The umbrella of claim 1 further including a hook member secured to said main hub member side surface for hanging said line member.

8. An umbrella pole support, comprising:

a base member having a top and a bottom surface, said base member also having a substantially cylindrical tube extending from said bottom surface, said cylindrical tube being hollow and defining a base opening;

a plate member hingedly secured to said base member top surface, said plate member having an inner surface and an outer surface and being sufficiently large to substantially cover said base opening;

a securing pin member mounted to said plate member inner surface; and a strap member mounted to said plate member.

9. The support of claim 8 wherein said strap member includes a snapping lock mechanism for securing around an umbrella pole.

10. An umbrella operating system, comprising:

a central pole member having a longitudinal axis and top and bottom ends;

a main hub member secured about said central pole member, said main hub member capable of sliding between said bottom and said top ends;

a secondary hub member secured to said pole member near said pole top end;

means for supporting a canopy member;

pulley means for raising and lowering said main hub member along said pole member;

means for securing said main hub member in a stationary position along said pole member, said securing means including a stabilizer arm having first and second ends, said first end being secured to said supporting means, said arm also including means for securing said second end to said pole member; and a pole support member having a base member, said base member having a top and a bottom surface, a substantially cylindrical tube extending from said bottom surface, said tube defining a base opening, said pole support member further having a plate member hingedly secured to said base member top surface, said plate member having pole securing means for securing said pole member within said tube.

11. An umbrella, comprising:

a central pole member having a longitudinal axis and top and bottom ends;

a main hub member secured about said central pole member, said main hub member capable of sliding between said bottom and said top ends and including a top surface and a side surface;

a secondary hub member secured to said pole member near said pole top end;

means for supporting a canopy member;

pulley means for raising and lowering said main hub member along said pole member;

means for securing said main hub member in a stationary position along said pole member;

said pulley means including a pair of pulley members secured to said secondary hub member and a third pulley member secured to said top surface of said main hub member;

a bracket member secured to said main hub member top surface, and a line member having first and second ends, said first end being secured to said bracket member, said line member cooperatively engaging each of said pulley members;

said secondary hub member includes a bottom surface and a central axis; and said pair of pulley members being spaced substantially radially equidistant from said secondary hub member axis on said secondary hub bottom surface.

12. The umbrella of claim 11 wherein said line member extends from said bracket member of said main hub member through a first one of said pair of pulley members secured to said secondary hub member, through said third pulley member secured to said main hub member, through a second one of said pair of pulley members secured to said secondary hub member and downwardly towards said pole bottom end.

* * * * *